US009899746B2

(12) United States Patent
Grandfield et al.

(10) Patent No.: US 9,899,746 B2
(45) Date of Patent: Feb. 20, 2018

(54) ELECTRONICALLY STEERABLE SINGLE HELIX/SPIRAL ANTENNA

(71) Applicant: The Charles Stark Draper Laboratory, Inc., Cambridge, MA (US)

(72) Inventors: John E. Grandfield, St. Petersburg, FL (US); Phillip Hulse, Tampa, FL (US); Matthew Shea, Safety Harbor, FL (US); Michael P. Abban, Weymouth, MA (US)

(73) Assignee: The Charles Stark Draper Laboratory, Inc., Cambridge, MA (US)

( * ) Notice: Subject to any disclaimer, the term of this patent is extended or adjusted under 35 U.S.C. 154(b) by 458 days.

(21) Appl. No.: 14/568,336

(22) Filed: Dec. 12, 2014

(65) Prior Publication Data

US 2015/0171517 A1 Jun. 18, 2015

Related U.S. Application Data

(60) Provisional application No. 61/916,184, filed on Dec. 14, 2013.

(51) Int. Cl.

| | |
|---|---|
| ***H01Q 21/29*** | (2006.01) |
| ***H01Q 3/28*** | (2006.01) |
| ***H01Q 1/36*** | (2006.01) |
| ***H01Q 3/34*** | (2006.01) |
| *H01Q 1/52* | (2006.01) |

(52) U.S. Cl.

CPC ..... *H01Q 21/29* (2013.01); *H01Q 1/362* (2013.01); *H01Q 3/28* (2013.01); *H01Q 3/34* (2013.01); *H01Q 1/526* (2013.01)

(58) Field of Classification Search

CPC ..... H01Q 3/26; H01Q 1/36; H01Q 1/362; H01Q 21/29

USPC ..... 343/895

See application file for complete search history.

(56) References Cited

U.S. PATENT DOCUMENTS 2,465,379 A * 3/1949 Kandoian ..... H01Q 21/26 343/723

5,317,327 A * 5/1994 Piole ..... H01Q 9/40 343/725

(Continued)

FOREIGN PATENT DOCUMENTS

FR 2644937 A1 * 9/1990 ..... H01Q 21/24

WO WO 0133666 A1 * 5/2001 ..... H01Q 1/3275

OTHER PUBLICATIONS

Wikipedia, Nantenna, 7 pages, dated Jun. 4, 2013.

(Continued)

*Primary Examiner* — Gregory C. Issing

(74) *Attorney, Agent, or Firm* — Sunstein Kann Murphy & Timbers LLP

(57) ABSTRACT

An electronically steerable helical or spiral antenna includes a monopole antenna element disposed within at least one helical or spiral antenna element. The antenna can be electronically steered, i.e., its radiation pattern can be altered, such that the antenna radiates in a desired direction, without mechanically changing a direction in which the antenna is aimed and without mechanically changing orientation of any of the antenna's elements, by adjusting amplitude and phase of a signal fed to the monopole antenna element, relative to a signal fed to the at least one helical or spiral antenna element.

16 Claims, 15 Drawing Sheets

(56) References Cited

U.S. PATENT DOCUMENTS

| | | | | |
|---|---|---|---|---|
| 6,094,178 | A * | 7/2000 | Sanford | H01Q 1/242 343/860 |
| 6,181,286 | B1 * | 1/2001 | Roscoe | H01Q 1/362 343/702 |
| 6,243,052 | B1 | 6/2001 | Goldstein et al. | 343/895 |
| 6,819,302 | B2 * | 11/2004 | Volman | H01Q 1/525 343/702 |
| 7,236,127 | B2 * | 6/2007 | Vaskelainen | H01Q 3/36 342/368 |
| 9,614,293 | B2 * | 4/2017 | Elliot | H01Q 21/28 |
| 2002/0018026 | A1 * | 2/2002 | Noro | H01Q 1/362 343/895 |
| 2005/0003864 | A1 * | 1/2005 | Elliot | H01Q 3/2629 455/562.1 |

OTHER PUBLICATIONS

Wikipedia, Electric-field screening, 4 pages, dated Jun. 7, 2013.
Wikipedia, Rectenna, 2 pages, dated Jun. 19, 2013.
Wikipedia, Polariton, 2 pages, dated Aug. 27, 2013.
Wikipedia, Plasma oscillation, 3 pages, dated Sep. 24, 2013.
Wikipedia, Plasmon, 5 pages, dated Sep. 24, 2013.
Wikipedia, Free electron model, 8 pages, dated Nov. 6, 2013.
Wikipedia, Quasiparticle, 6 pages, dated Nov. 10, 2013.
Wikipedia, Relative permittivity, 6 pages, dated Nov. 13, 2013.
Wikipedia, Quantization (physics), 4 pages, dated Nov. 16, 2013.

* cited by examiner farfield (f=300) [1[1,0]+2[1,90]+3[1,180]+4[1,270]+5[1,0]

ELECTRONICALLY STEERABLE SINGLE HELIX/SPIRAL ANTENNA

CROSS REFERENCE TO RELATED APPLICATIONS

This application claims the benefit of U.S. Provisional Patent Application No. 61/916,184, filed Dec. 14, 2014, titled "Electronically Steerable Single Helix/Spiral Antenna," the entire contents of which are hereby incorporated by reference herein, for all purposes.

TECHNICAL FIELD

The present invention relates to radio frequency antennas and, more particularly, to electronically steerable helical or spiral antennas.

BACKGROUND ART

An antenna, also known as an aerial, is an electronic device that converts electric power into radio waves and vice versa. Antennas are used to transmit and/or receive radio frequency (RF) signals. An antenna element is an electrically conductive member of an antenna. Various arrangements of antenna elements are known, such as dipole, monopole, Yagi and helix, each arrangement having a characteristic radiation pattern, impedance, etc. For example, helical antennas are widely used for space communication, because helical antennas inherently transmit circularly polarized radio waves and can receive linearly polarized signals, regardless of the linear polarization orientation. This is important, at least in part because orientation of an antenna on a spacecraft changes as the spacecraft orbits or spins, thereby making it difficult or impossible to maintain linear polarization alignment between the spacecraft antenna and a ground-based antenna.

A directional antenna is an antenna that radiates greater power in one or more directions than in other directions. A directional antenna is correspondingly more sensitive to signals received from one or more directions than from other directions. A directional antenna may be physically aimed toward a receiving antenna, such as an antenna on a spacecraft, to concentrate transmitted power toward the receiving antenna, rather than directions that do not contribute to reception by the spacecraft or to reduce signal power toward an unintended receiver. Similarly, a directional antenna may be physically aimed to receive desired signals from a particular direction and reduce reception of unwanted interference by signals from other directions.

Mechanically reorienting an antenna imposes limitations on speed with which the antenna's orientation can be changed, accuracy of aiming the antenna, reliability of mechanical devices used to support and orient the antenna, etc. To overcome these and other limitations, some antenna arrays (also known as phased arrays) are steered electronically. Signals with particular phase relationships are fed to antennas of a phased array, such that constructive and destructive interference between radiated signals from the individual antennas of the array yield a radiation pattern that is reinforced in a desired direction and suppressed in undesired directions. The radiation pattern can be reshaped very quickly, enabling phased arrays to be used in radar systems to track multiple moving targets. However, phased arrays are much larger than a single antenna of such an array.

Phased arrays of helical antennas have been described in the prior art. For example, U.S. Pat. No. 6,243,052 by M. Larry Goldstein, et al. describes a phased array antenna having a spatially periodic array of helical antenna elements and RF feed circuitry.

A steerable beam helical antenna is described in U.S. Pat. No. 5,612,707 by Rodney G. Vaughan. The Vaughan device uses a furled dielectric sheet on which one or more conductors are fixed. By furling and unfurling the dielectric sheet, the antenna beam may be steered. However, furling and unfurling the dielectric sheet is a mechanical process, which suffers from the deficiencies mentioned above, with respect to mechanical antenna aiming systems.

Thus, while beam steering is important for many applications, it is often limited by space, overall size of the system and other factors.

SUMMARY OF EMBODIMENTS

An embodiment of the present invention provides an electronically steerable radio frequency antenna. The antenna includes at least one helical antenna element wound about a single longitudinal axis. The at least one helical antenna element defines a volume. The antenna also includes a straight antenna element disposed within the volume. The straight antenna element is oriented along the single longitudinal axis. The straight antenna element may be a monopole antenna element. The straight antenna element is configured to be fed at a proximal end. The distal end of the straight antenna element terminates without any electrical connection to any other antenna element.

The electronically steerable radio frequency antenna may also include a feed circuit electrically coupled to the at least one helical antenna element and to the straight antenna element.

The feed circuit may be configured to receive an input signal. The feed circuit may also be configured to provide a first version of the input signal to the at least one helical antenna element. The feed circuit may be configured to provide a second version of the input signal to the straight antenna element. The feed circuit may also be configured to control relative amplitude and relative phase of the first and second versions of the input signal.

The feed circuit may include a variable delay circuit configured to control the relative phase of the first and second versions of the input signal.

The electronically steerable radio frequency antenna may also include a ground plane disposed adjacent one end of the at least one helical antenna element. The ground plane may be oriented perpendicular to the single longitudinal axis.

The at least one helical antenna element may include four helical antenna elements arranged as a quadrifilar helix.

The electronically steerable radio frequency antenna may include a feed circuit electrically coupled to the straight antenna element and to each antenna element of the four helical antenna elements. The feed circuit may be configured to receive an input signal. The feed circuit may also be configured to provide a first version of the input signal to the at least one helical antenna element. The feed circuit may be configured to provide a second version of the input signal to the straight antenna element. The feed circuit may also be configured to control relative amplitude and relative phase of the first and second versions of the input signal.

An embodiment of the present invention provides a method for electronically steering a radio frequency antenna. The method includes receiving an input signal. A first version of the input signal is provided to at least one helical antenna element. A second version of the input signal is provided to a straight antenna element disposed along an axis of the at least one helical antenna element. The straight antenna element is disposed within a volume defined by the at least one helical antenna element. Relative amplitude and relative phase of the first and second versions of the input signal are controlled.

Controlling the relative amplitude and the relative phase of the first and second versions of the input signal may include adjusting the relative amplitude of the second version of the input signal according to a theta direction control signal and adjusting the relative phase of the second version of the input signal according to a phi direction control signal.

Adjusting the relative phase of the second version of the input signal may include delaying the second version of the input signal by an amount that depends on the phi direction control signal.

BRIEF DESCRIPTION OF THE DRAWINGS

The invention will be more fully understood by referring to the following Detailed Description of Specific Embodiments in conjunction with the Drawings, of which.

DETAILED DESCRIPTION OF SPECIFIC EMBODIMENTS

In accordance with embodiments of the present invention, methods and apparatus are disclosed for electronically steering a helical or spiral antenna. The antenna can be steered, i.e., its radiation pattern can be altered, such that the antenna radiates in a desired direction, without mechanically changing a direction in which the antenna is aimed and without mechanically changing orientation of any of the antenna's elements. The antenna's beam can be steered 360° in phi and 90° in the theta direction, while maintaining good gain. Advantages of the disclosed antenna include reduced size and complexity of elements over conventional antennas, leading to simpler designs.

As noted, there are many applications that require the beam of an antenna to be steered in different directions, without sacrificing gain or directivity. One method to change the direction of the antenna beam pattern is to physically move the antenna structure to point in the desired direction using a mechanical positioner. However, mechanical positioners tended to be large, slow, and require substantial DC power to move an antenna.

Another method to steer an antenna's beam is to use a phased array. Traditionally, phased arrays consist of multiple antenna elements separated by half a wavelength, which can occupy a considerable amount of space. To steer a beam using a phased array, for a full planner 2D pattern, a minimum array size of 4 elements is needed (2×2), in which horizontally and vertically adjacent elements in the array are separated by ½ wavelength from each other. Each element of the phased array antenna system is excited by various phases and amplitudes to radiate the antenna beam in a desired direction. In order to achieve the proper phasing and amplitude, extra circuitry is required for phase shifting, splitting or combining power and attenuating or amplifying power. This can make the antenna design complex and increase the overall mechanical footprint of the antenna.

Figure 1:
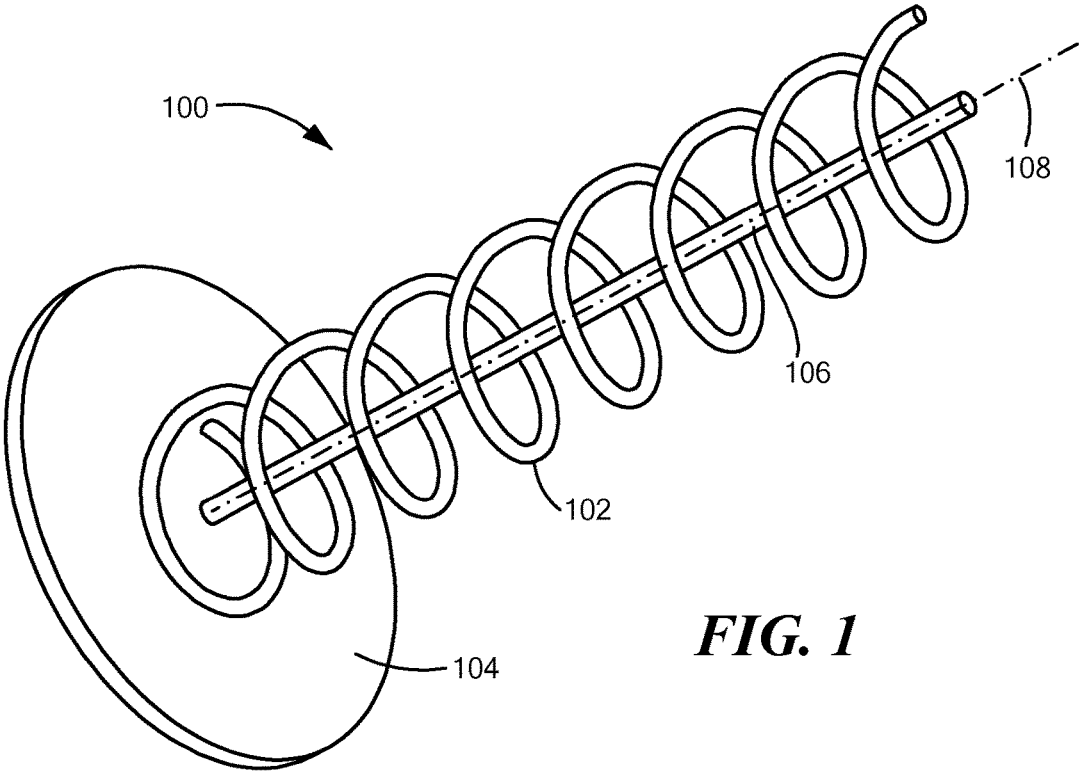
FIG. 1 is a perspective schematic view of an electronically steered helical antenna, according to an embodiment of the present invention.

FIG. 1 is a perspective schematic view of an electronically steered helical antenna 100, according to an embodiment of the present invention. The antenna 100 includes a helical antenna element 102 and a ground plane 104, as in a conventional helical antenna. However, the antenna 100 also includes a monopole antenna element 106 disposed within a volume defined by the helical antenna element 102. The monopole antenna element 106 is disposed along the axis 108 about which the helical antenna element 102 is wound. Thus, the monopole antenna element 106 is centered within the helical antenna element 102.

Dimensions of the helical antenna element 102 and the ground plane 104 may be calculated according to well-known formulas for a desired operating frequency or range of frequencies. Examples of these formulas, as well as other construction details for helical and other antennas, are available in many texts, such as "The ARRL Antenna Book," 21st Edition, ISBN 0-87259-987-6 (see, for example, pp. 19-6 to 19-9) and Joseph J. Carr, "Practical Antenna Handbook," ISBN 0-07-137435-3 (see, for example, pp. 427-431), the entire contents of all of which are hereby incorporated by reference herein.

The monopole antenna element 106 may be sized as a ¼-wavelength monopole antenna, a ½-wavelength monopole antenna or any other suitable length monopole antenna. (See, for example, the above-referenced "The ARRL Antenna Book," pp. 2-17 to 2-18, for information about monopole antennas.)

It should be noted that the end of the monopole antenna element 106 opposite the feed end is open, i.e., it is not connected to a loop antenna element or an additional helical antenna element, such as to provide a dual-band antenna, as described by P. Eratuuli, P. Haapala, and P. Vainikainen, "Dual frequency wire antennas," Electronics Letters, Vol. 32, No. 12, pp. 1051-1052, Jun. 6, 1996.

The antenna 100 may be electronically steered by varying phase and amplitude of a signal fed to the monopole antenna element 106, relative to a signal fed to the helical antenna element 102. By changing the relative phase of the signal fed to the monopole antenna element 106, the beam direction can be manipulated in the phi direction. By changing the relative weights (amplitudes) of the signals fed to the monopole antenna element 106 versus the helical antenna element 102, the beam direction can be manipulated in the theta direction. For example, directing all of the power into the helical antenna element 102, the antenna 100 radiates at zenith (0°). Directing all of the power into the monopole antenna element 106 causes the antenna 100 to radiate through sides of the helical antenna element 102 (90°). If both antenna element signals are weighted equally in amplitude, the antenna 100 radiates at 45°. Other radiation angles may be achieved by other power distribution weightings (ratios).

Although the antenna 100 is shown with a single helical antenna element 102, other embodiments of the present invention may include other numbers of helical antenna elements interwound with each other. One such embodiment 200 is shown schematically in perspective in FIG. 2. Here, four helical antenna elements 202, 204, 206 and 208 are configured as an open-ended quadrifilar helical antenna (QHA). The antenna 200 includes a ground plane 210 and a monopole antenna element 212. As with the embodiment described with reference to FIG. 1, directing all of the power into the QHA causes the antenna 200 to radiate at zenith (0°), whereas directing all of the power into the monopole antenna element 212 causes the antenna 200 to radiate through the sides of the QHA (90°). If both antenna signals are weighted equally in amplitude, the antenna 200 radiates at 45°.

Figure 2:
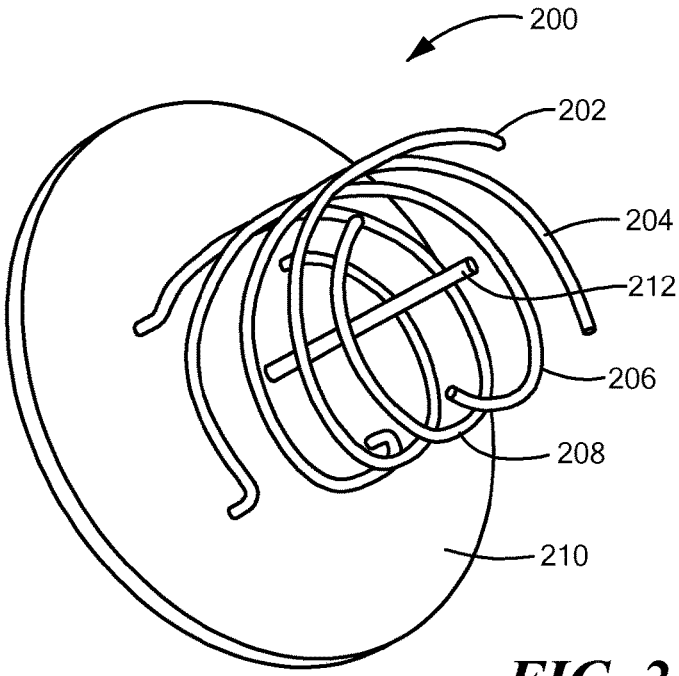
FIG. 2 is a perspective schematic view of an electronically steered helical antenna, according to another embodiment of the present invention.
Figure 3:
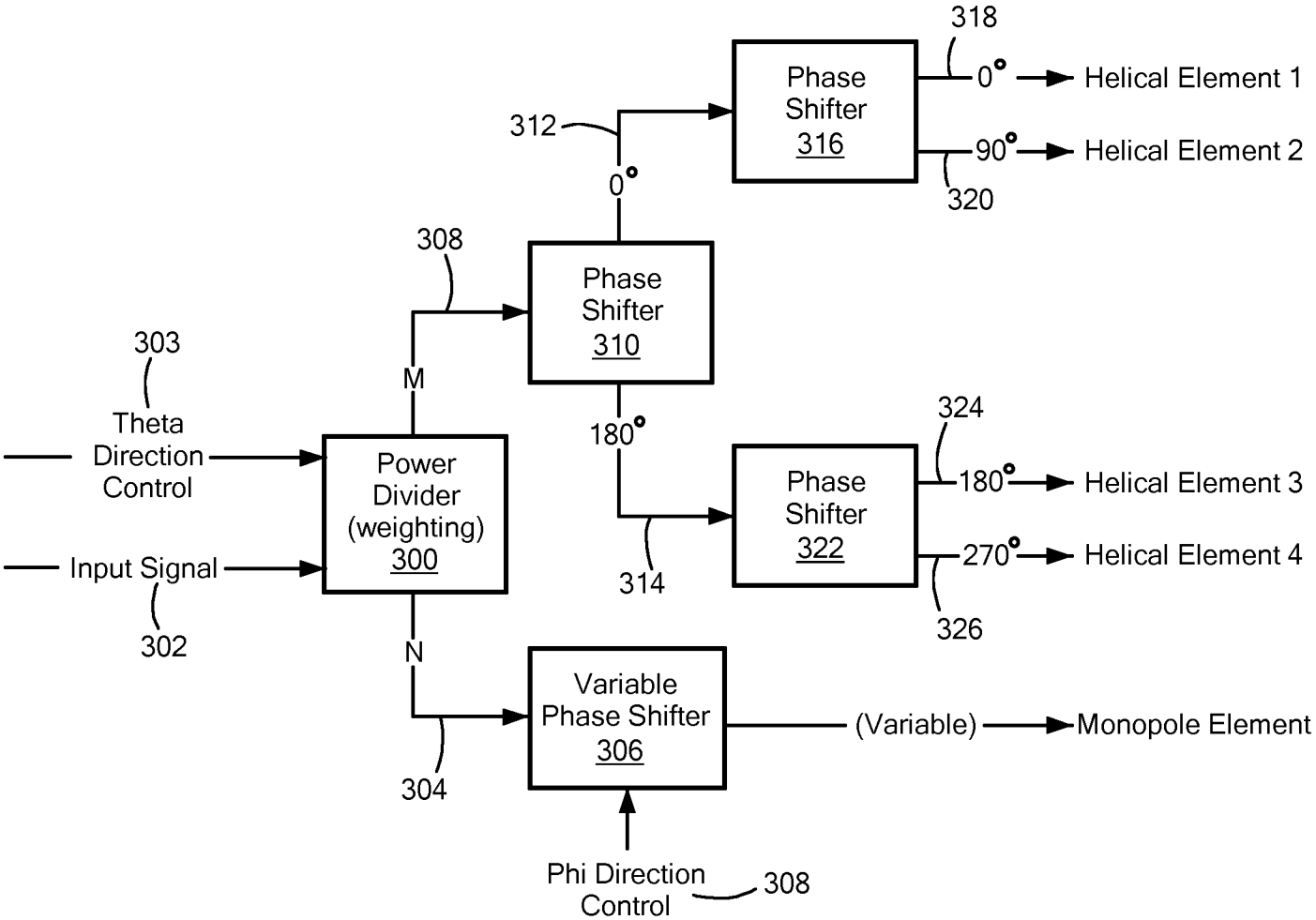
FIG. 3 is a schematic block diagram of a signal distribution circuit that feeds the antenna elements of the antenna of FIG. 2, according to an embodiment of the present invention.

FIG. 3 is a schematic block diagram of a signal distribution circuit that feeds the antenna elements of the antenna 200 of FIG. 2, according to an embodiment of the present invention. A power divider (weighting) circuit 300 divides an input signal 302 between the QHA and the monopole antenna element 212 according to a theta direction control signal 303. The ratio M:N represents the relative amount of the input signal 302 that is fed to the QHA, versus to the monopole antenna element 212.

The portion (N) 304 of the input signal is fed into a variable phase shifter 306, which shifts the phase of the portion (N) by an amount specified by a phi direction control signal 308. The variable phase shifter 306 may be implemented with a variable delay line or other suitable circuit. The output of the variable phase shifter 306 is fed to the monopole antenna element 212.

The portion (M) 308 of the input signal is fed into a phase shifter 310. The phase shifter 310 may be implemented with a delay line whose length depends on the wavelength of the input signal 302 or by any other suitable circuit. One output of the phase shifter 310 provides a signal 312 with 0° phase shift, relative to the input signal 302, whereas another output of the phase shifter 310 provides a signal 314 with a 180° phase shift, relative to the input signal 302. The signal 312 is fed into a second phase shifter 316. One output of the second phase shifter 316 provides a signal 318 with a 0° phase shift, relative to the input signal 302, whereas another output of the phase shifter 316 provides a signal 320 with a 90° phase shift, relative to the input signal 302. The signals 318 and 320 are fed to two of the QHA elements 202 and 204 (FIG. 2), respectively.

Similarly, a third phase shifter 322 receives the signal 314 and provides a signal 324 with 180° phase shift, relative to the input signal 302, whereas another output of the third phase shifter 322 provides a signal 326 with a 270° phase shift, relative to the input signal 302. The signals 324 and 326 are fed to the remaining two QHA elements 206 and 208 (FIG. 2), respectively.

In some embodiments, the amplitude and phase of the signals fed to the QHA elements 202-208 remain unchanged as the antenna 200 is steered. In these embodiments, only the amplitude and phase of the signal fed to the monopole antenna element 212 varies to electronically steer the antenna 200. In other embodiments, the amplitude and/or phases of the signals fed to the elements 202-208 of the QHA may also be varied to steer the antenna 200.

In some embodiments, the helical elements may be conical or otherwise tapered, open-ended or short-circuited and/or self-phased (not shown). The helical antenna elements may be self-supporting or they may be attached to dielectric supports. The supports may be circular, square or have some other cross-sectional shape. Similarly, the windings of the helical antennal elements by be circular, square or have some other geometric or arbitrary shape. Size reductions of quadrifilar or other helical antennas may be achieved through geometric reduction techniques, such as stub loading, sinusoidal, rectangular, meander line or other techniques. Optionally or alternatively, other variations of a helical antenna may be used.

Figure 4:
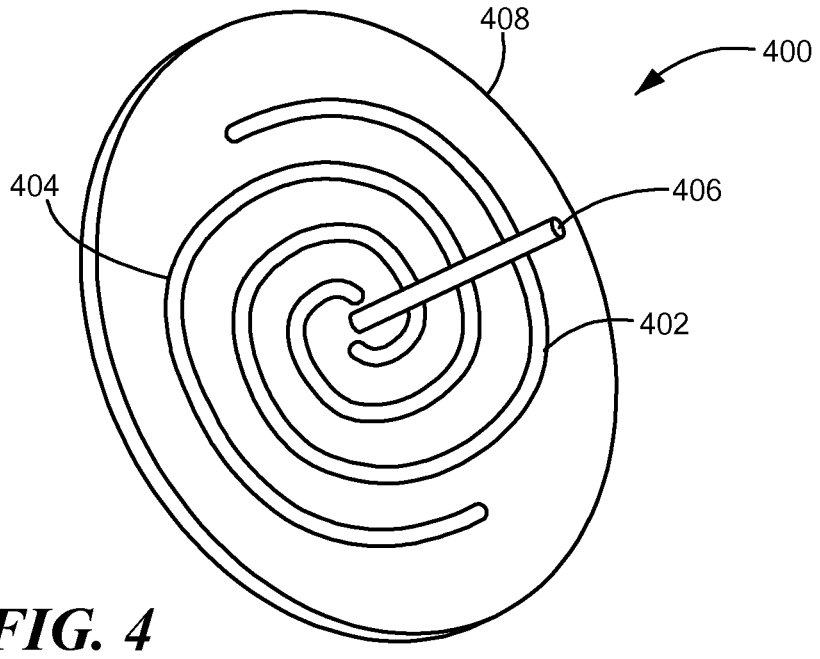
FIG. 4 is a perspective schematic view of an electronically steered spiral antenna, according to another embodiment of the present invention.

In yet other embodiments, the helical antenna element(s) may be replaced by spiral, i.e., planar, antenna element(s), as shown schematically in FIG. 4. FIG. 4 shows an antenna 400 that includes two interwound spiral antenna elements 402 and 404 and a monopole antenna element 406, as well as an optional ground plane 408. In other respects, the antenna 400 of FIG. 4 is operated in a manner similar to the antennas 100 and 200 described above, mutatis mutandis. Furthermore, an array of steerable helical or spiral antennas, all fed so as to direct their respective beams to be parallel or to be aimed at a desired target, may be used to increase gain over a single such antenna.

Figure 5:
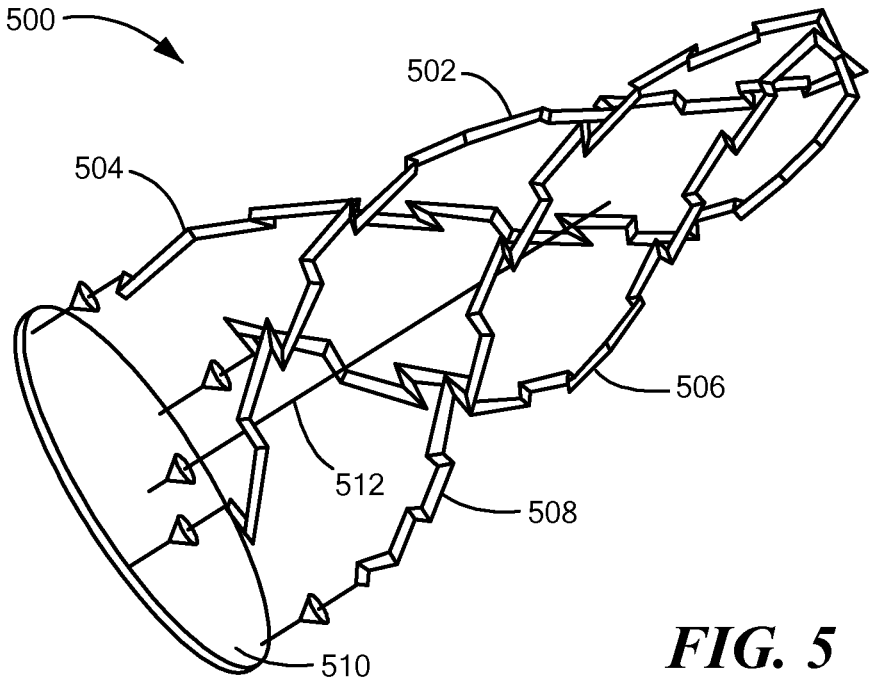
FIG. 5 is a perspective schematic diagram of an electronically steerable short-circuited, tapered QHA antenna having four meandering antenna elements, according to yet another embodiment of the present invention.

FIG. 5 is a perspective schematic diagram of an electronically steerable antenna 500, according to yet another embodiment of the present invention. The antenna 500 includes a short-circuited, tapered QHA having four meandering antenna elements 502, 504, 506 and 508. The antenna 500 also includes a ground plane 510 and a monopole antenna element 512. In other respects, the antenna 500 of FIG. 5 is constructed and operated in a manner similar to the antennas 100, 200 and 400 described above, mutatis mutandis.

The antenna 500 was modeled using a finite element analysis program, CST Studio Suite. The design was simulated as a 5-port network, with the first 4 ports being the helical antenna elements of the quadrifilar helix, and the monopole antenna element as the fifth port of the model.

Figure 6:
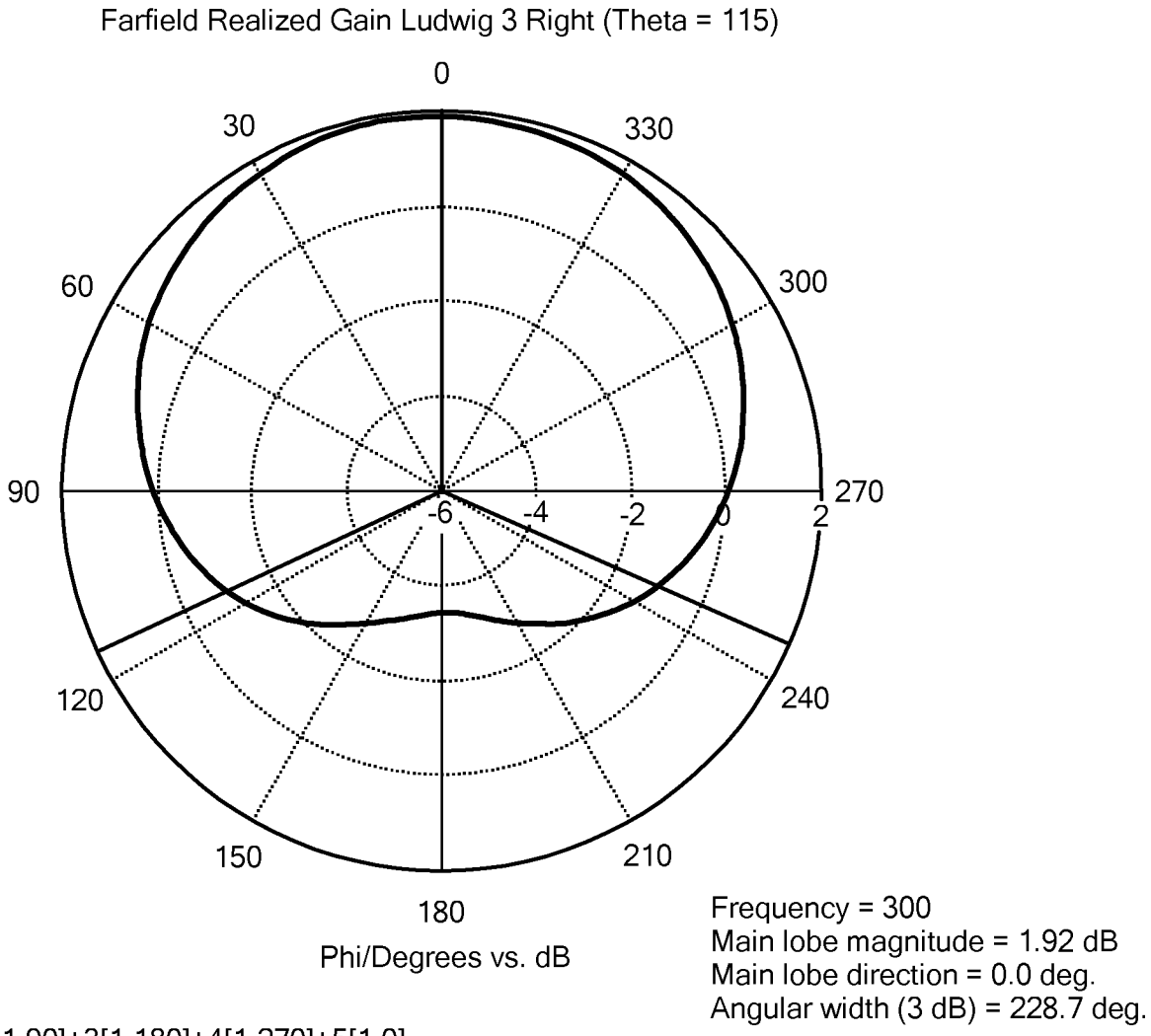
FIGS. 6-8 show antenna radiation patterns plotted in the phi direction, with a monopole element being fed with a signal that is phased at various values, relative to a signal fed to a first helical antenna element, according to an embodiment of the present invention.

FIG. 6 shows an antenna pattern plotted in the phi direction, with the monopole element being fed with a signal that is phased at 0°, relative to the signal fed to the first helical antenna element. Theta is at 115°.

Figure 7:
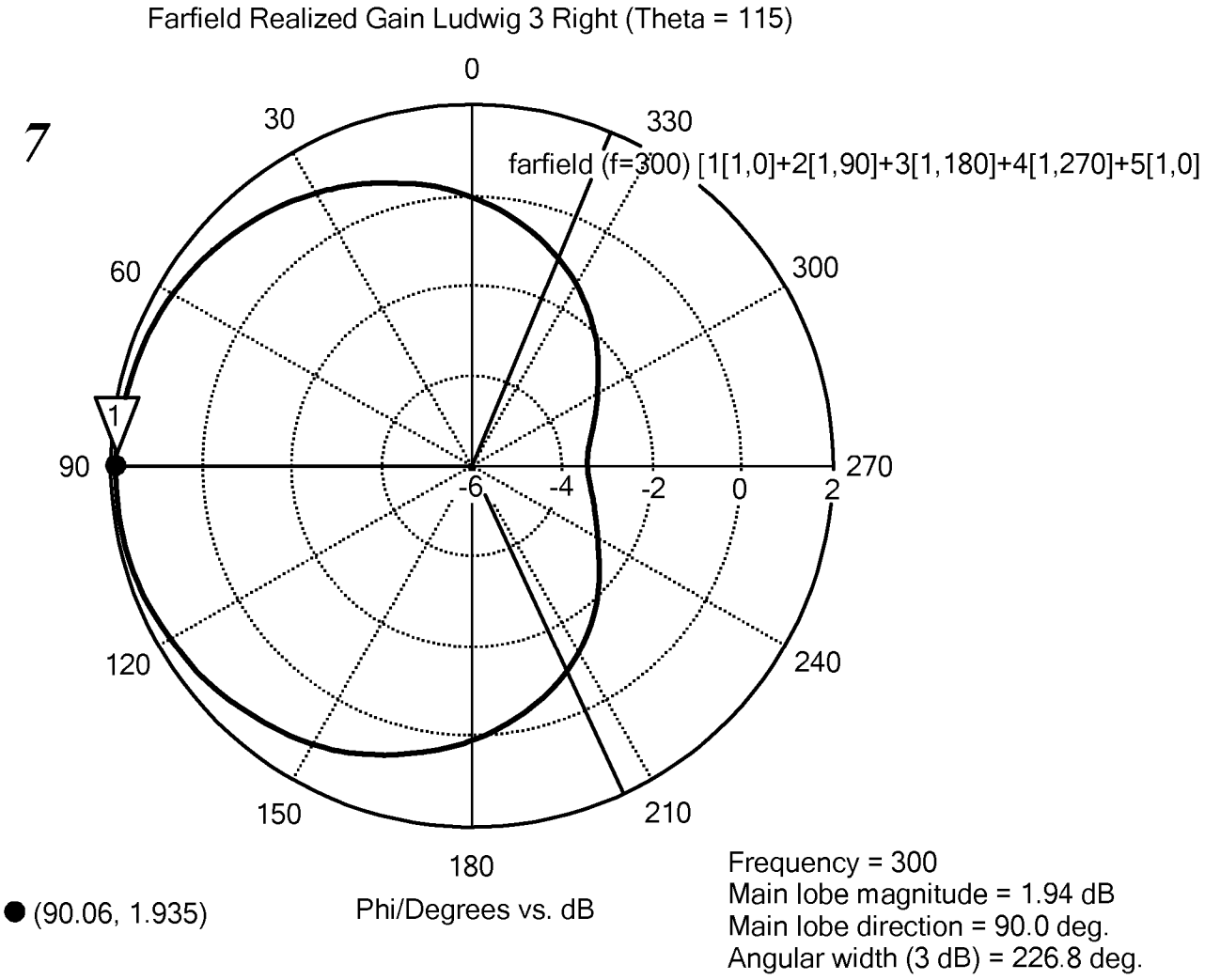

FIG. 7 shows the antenna pattern in the phi direction with the monopole being fed with a signal that is phased at 90°, relative to the signal fed to the first helical antenna element. Theta is at 115°. Here we observe the main lobe shift to the direction of the monopole's phase.

Figure 8:
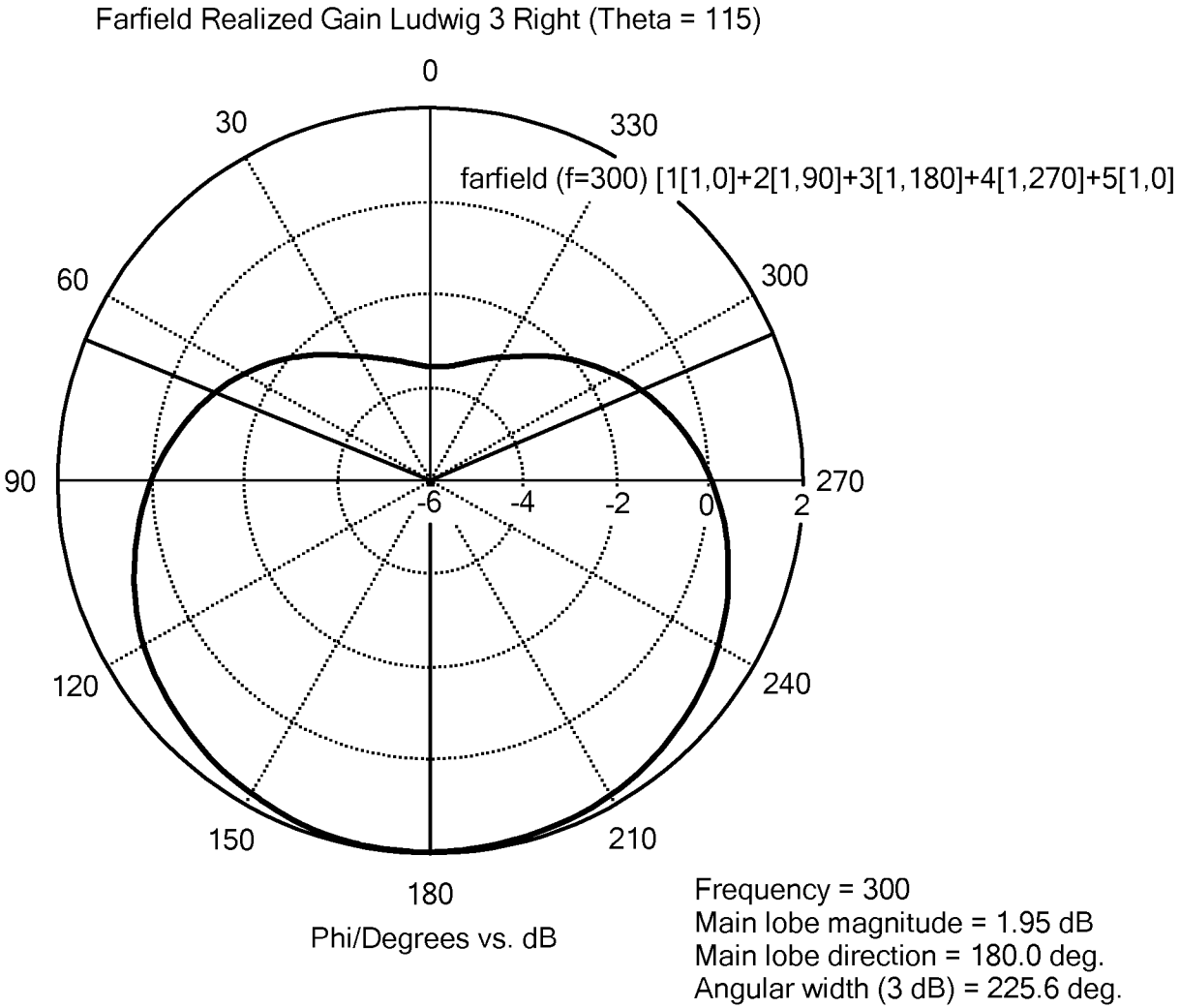

FIG. 8 shows the antenna pattern in the phi direction, with the monopole being fed with a signal that is phased at 180°, relative to the signal fed to the first helical antenna element. Theta is at 115°. Here we observe the main lobe shift to the direction of the monopole's phase.

Figure 9:
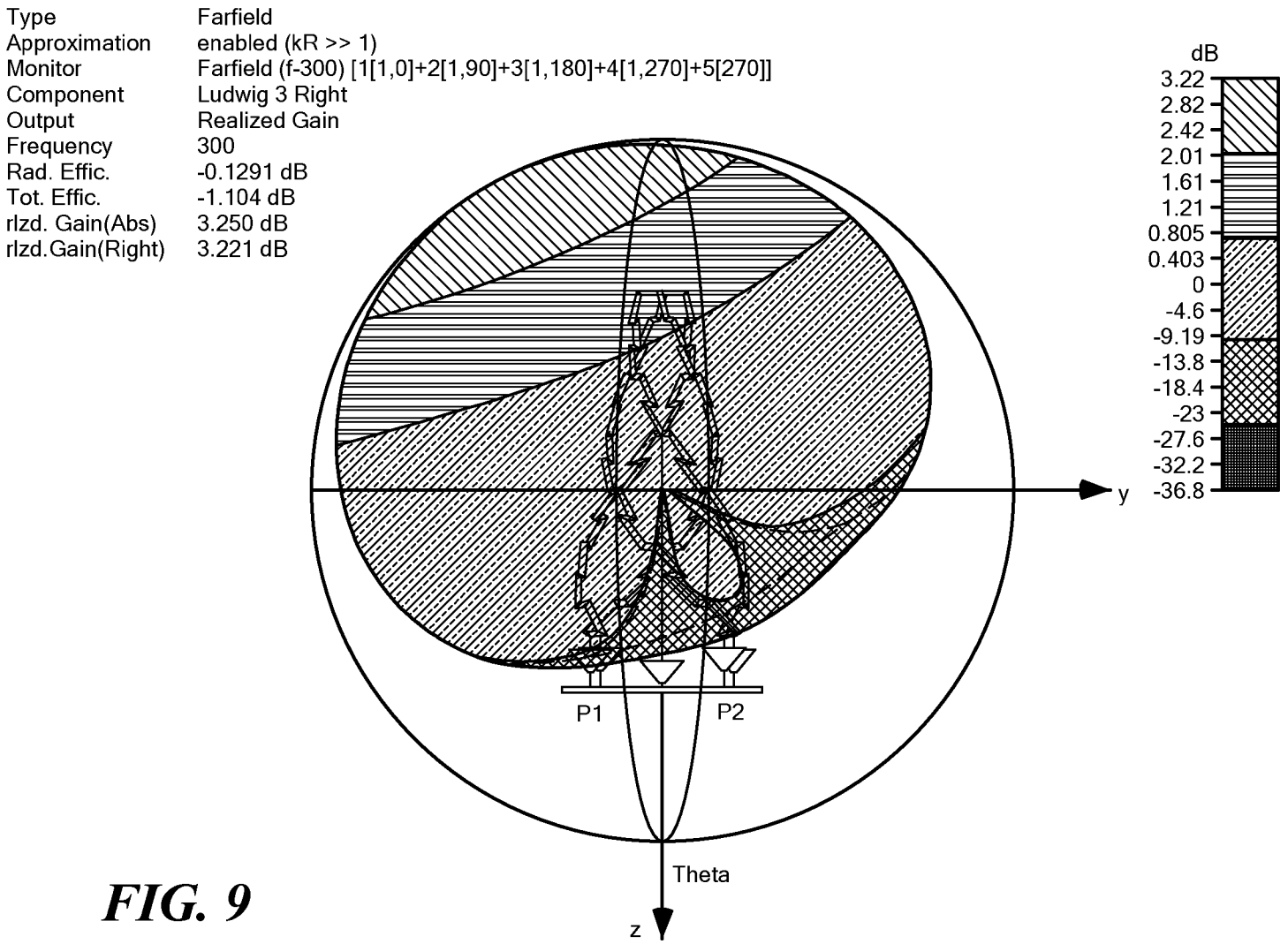
FIGS. 9-11 show beam patterns shifted in the theta direction by changing amplitude of the signal fed to the monopole antenna element, according to an embodiment of the present invention.
Figure 10:
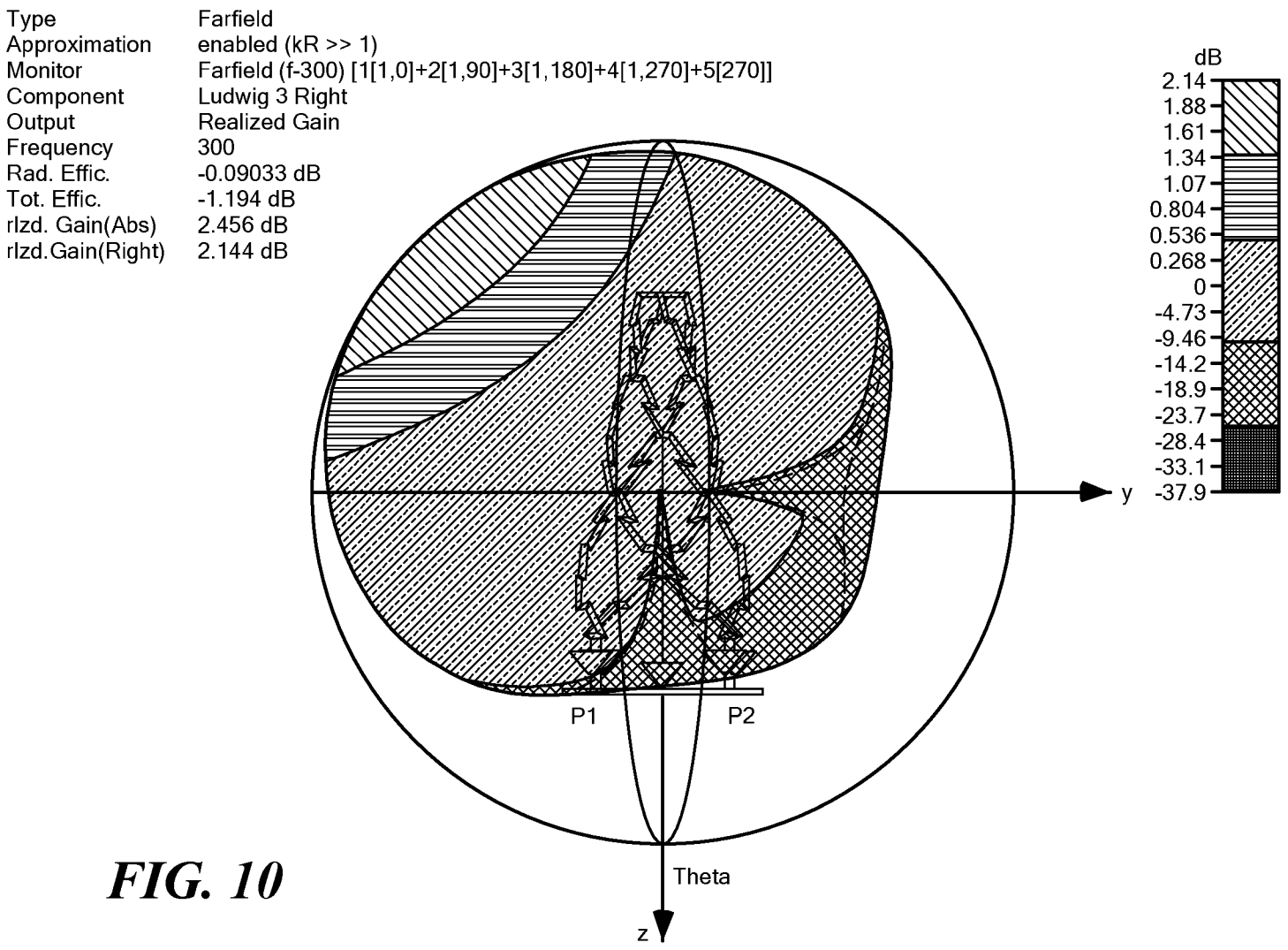
Figure 11:
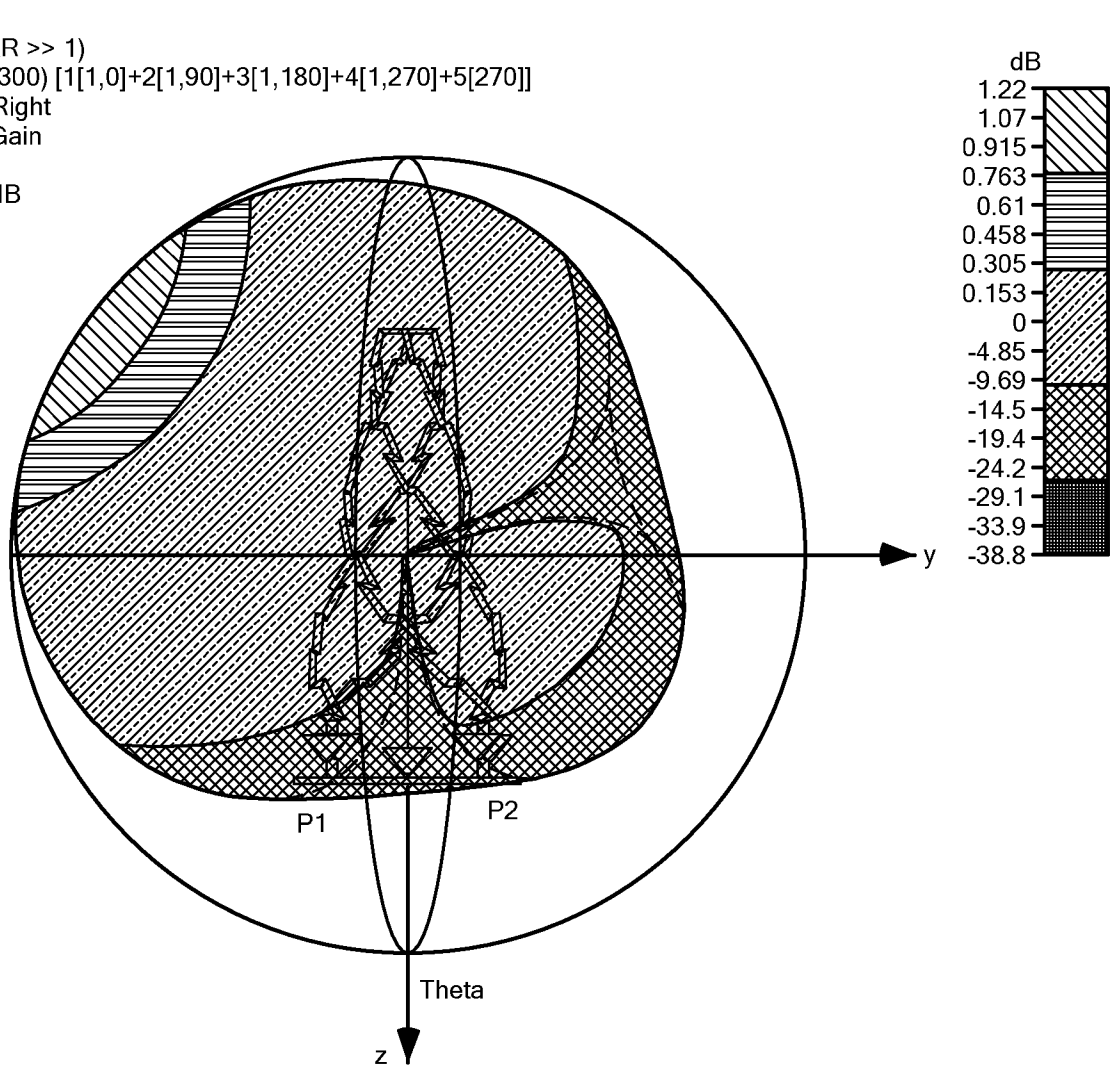

In FIGS. 9-11, the beam pattern is shifted in the theta direction by changing the amplitude of the signal fed to the monopole antenna element. FIG. 9 shows an antenna radiation pattern when the amplitude of the signal fed to the monopole antenna element is equal to the amplitude of the signal fed to the helical antenna elements. FIG. 10 shows the antenna radiation pattern when the amplitude of the signal fed to the monopole antenna element is equal to two times the amplitude of the signal fed to the helical antenna elements. FIG. 11 shows the antenna radiation pattern when the signal fed to the monopole antenna element is equal to three times the amplitude of the signal fed to the helical antenna elements.

Figure 12:
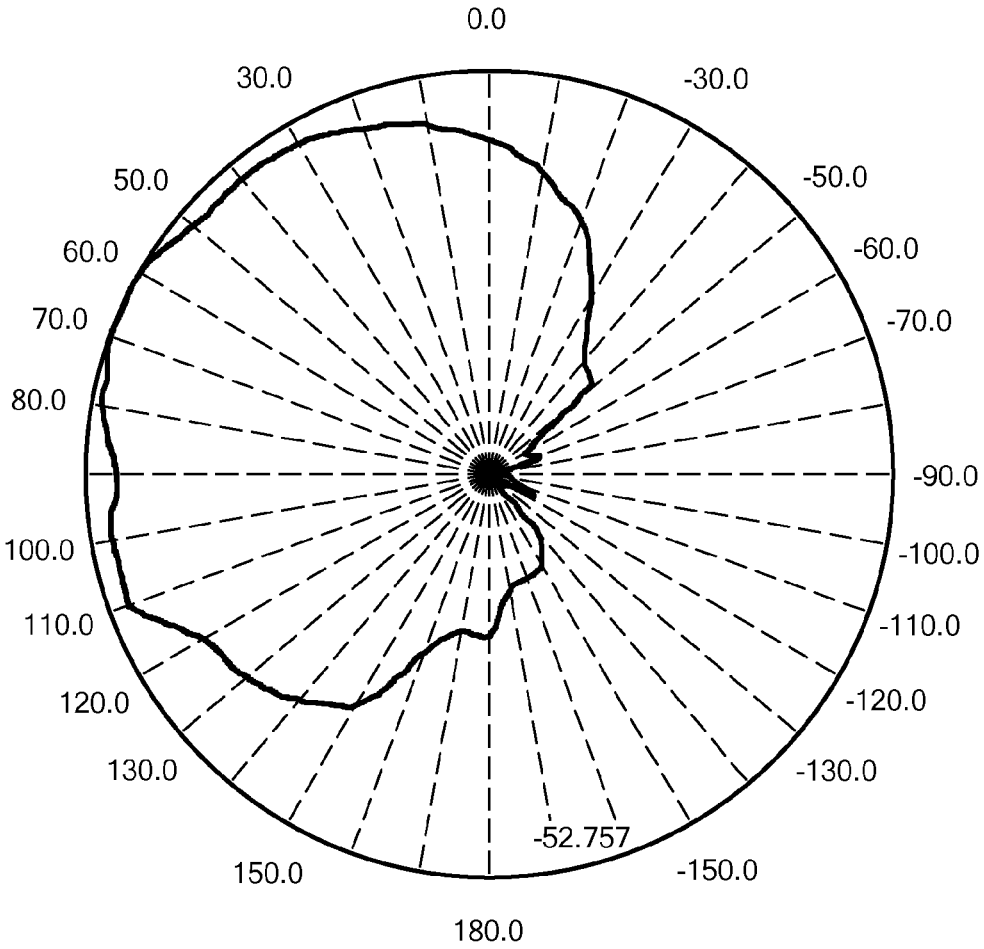
FIGS. 12-14 show the beam direction change with different phasing being applied to the signal fed to the monopole antenna element, according to an embodiment of the present invention.
Figure 13:
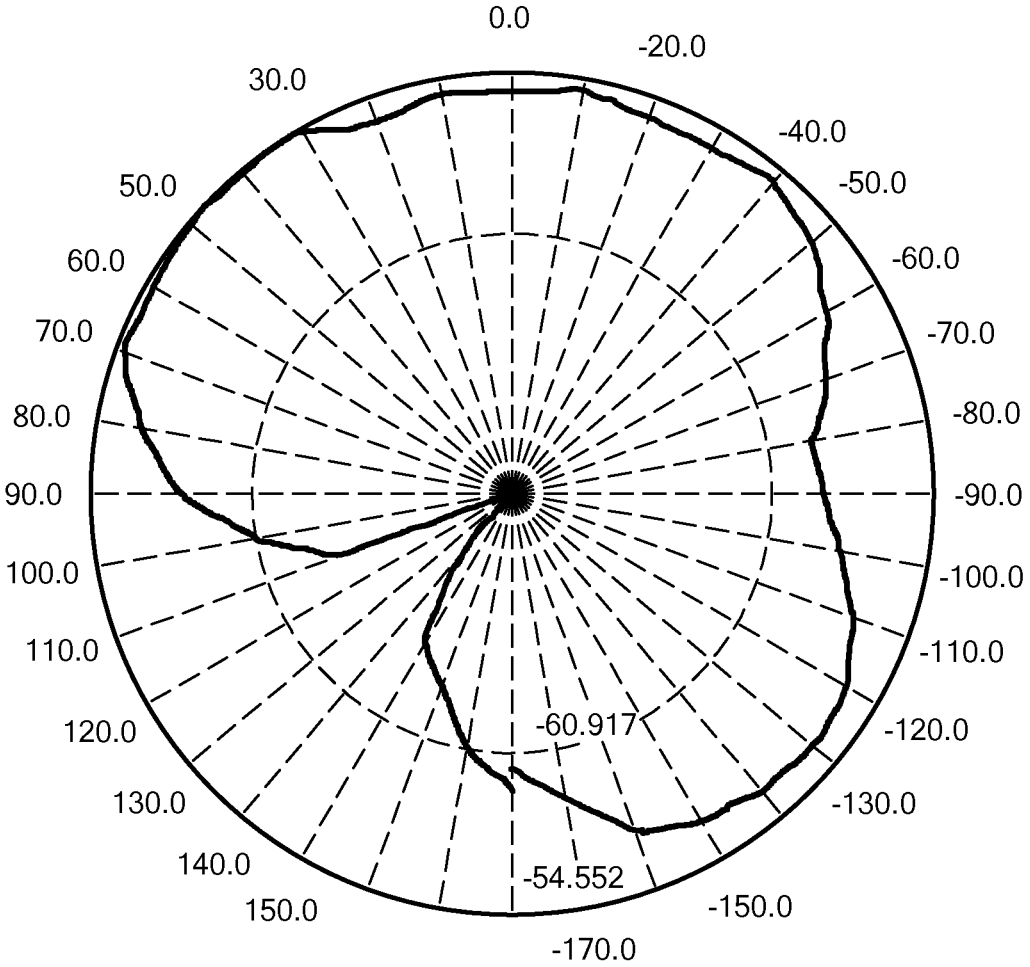
Figure 14:
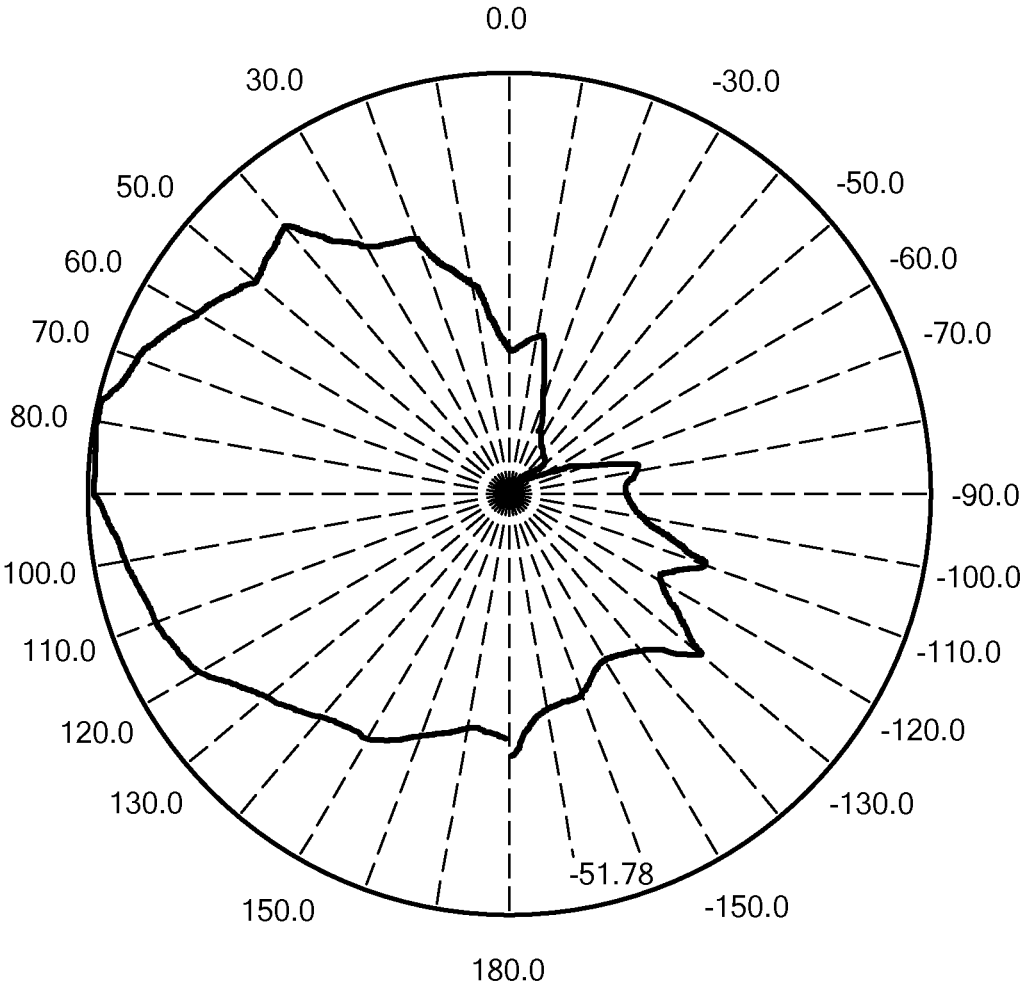

A functional embodiment was tested. Measurements were made using a quadrifilar helix antenna as a transmitting antenna. FIGS. 12-14 show the beam direction change with different phasing being applied to the signal fed to the monopole antenna element. The monopole element receives four times the power of the helix, and the antenna is held constant in the theta angle but swept across the phi angle 0° to 360°.

FIG. 12 shows a polar plot when the monopole element is fed with a signal phased at 90°, relative to the signal fed to the helical elements. FIG. 13 shows a polar plot when the monopole element is fed with a signal phased at 180°, relative to the signal fed to the helical elements. FIG. 14 shows a polar plot when the monopole element is fed with a signal phased at 0°, relative to the signal fed to the helical elements.

Figure 15:
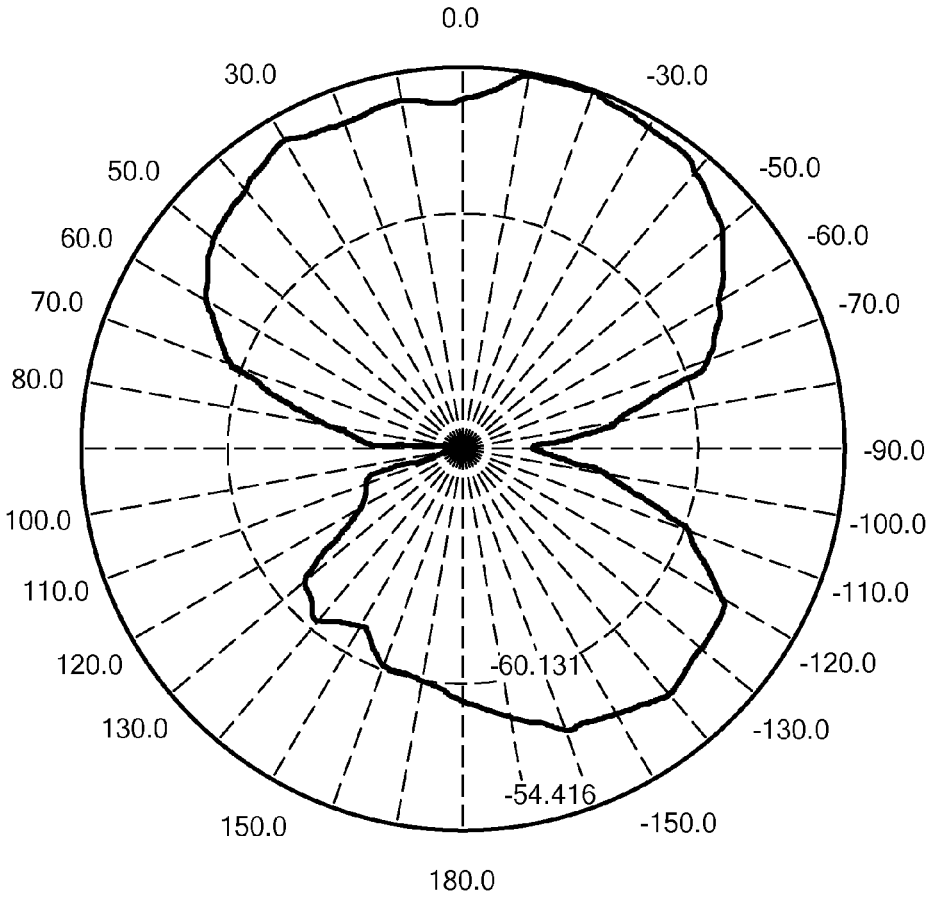
FIGS. 15-17 show the beam direction change with the phase of the monopole held constant, but with the amplitude of the signal delivered to the monopole adjusted, according to an embodiment of the present invention.
Figure 16:
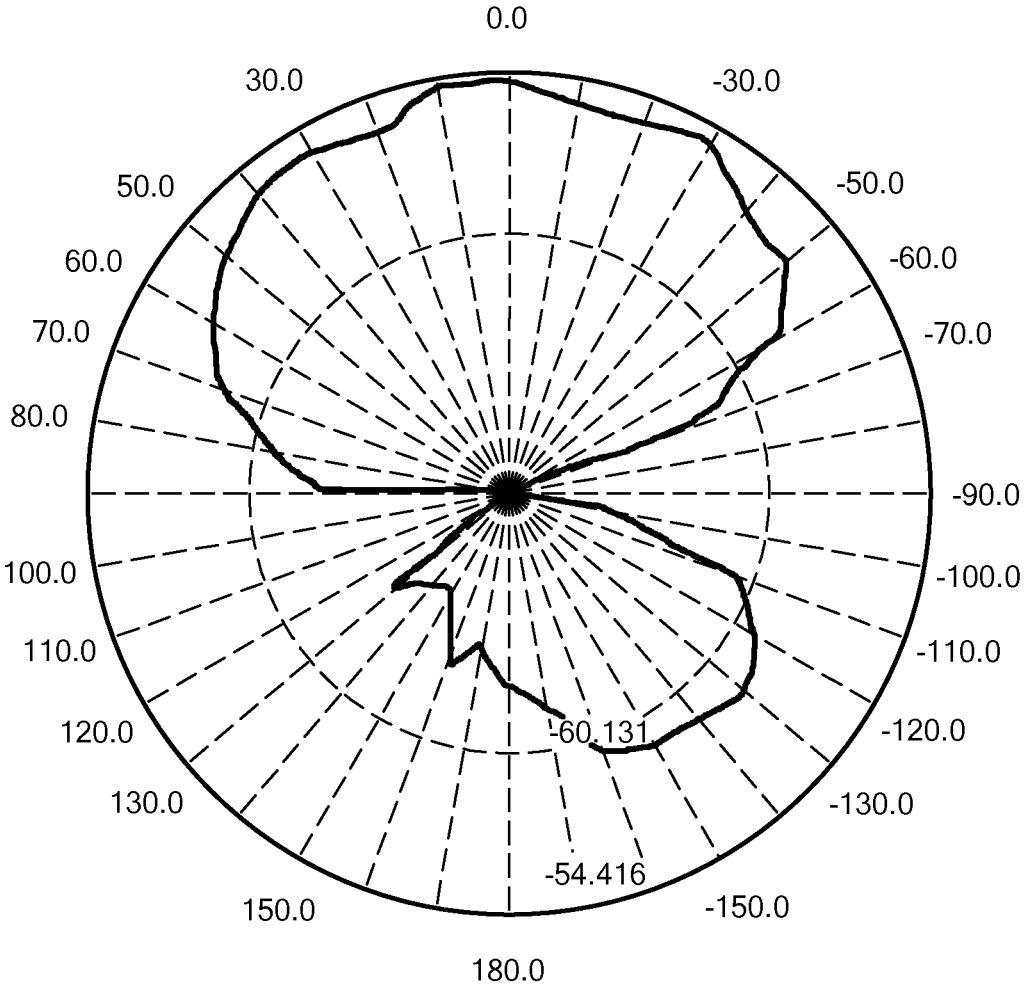
Figure 17:
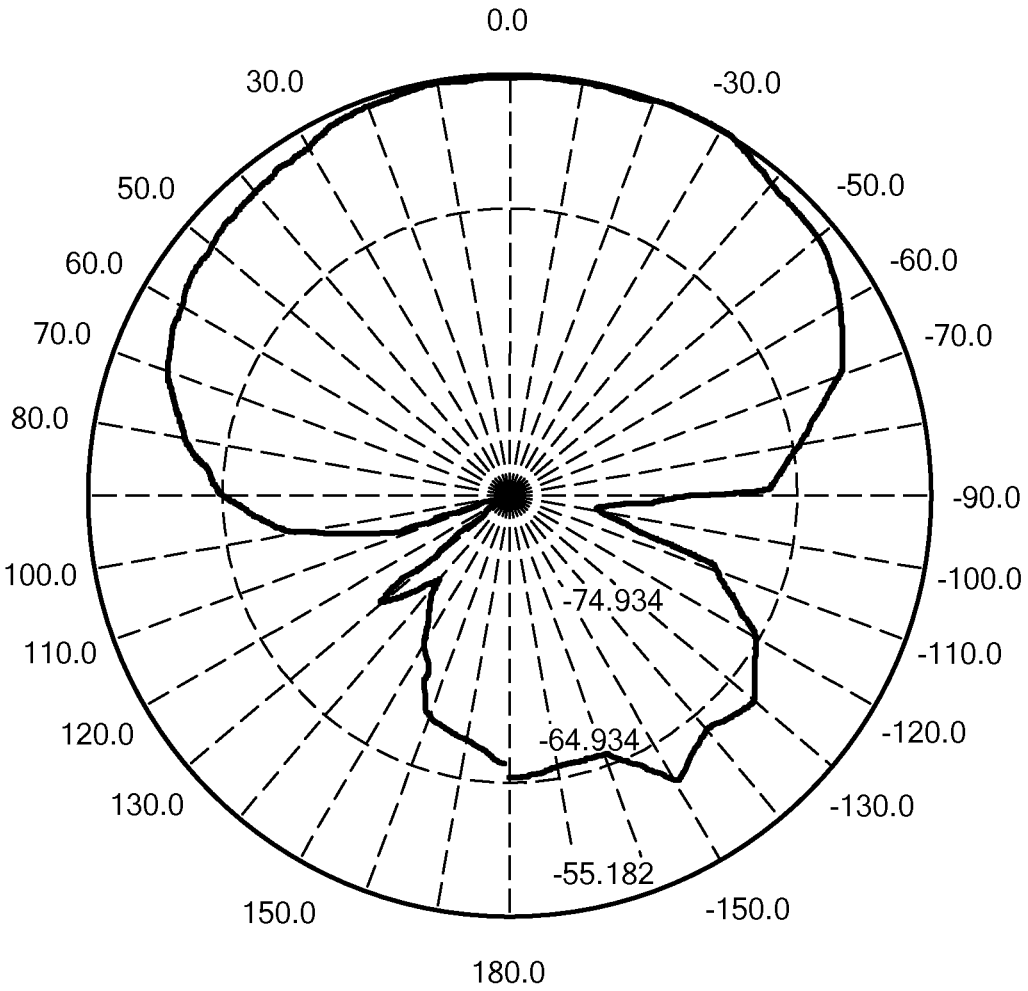

In the FIGS. 15-17, the phase of the monopole was held constant, but the amplitude of the signal delivered to the monopole was adjusted. The phi angle was held constant and the theta angle was swept 0° to 360°.

FIG. 15 shows a polar plot when the monopole element is fed with a signal whose amplitude is four times the amplitude of the signal fed to the helical antenna elements. FIG. 16 shows a polar plot when the monopole element is fed with a signal whose amplitude is two times the amplitude of the signal fed to the helical antenna elements. FIG. 17 shows a polar plot when the monopole element is fed with a signal whose amplitude is equal to the amplitude of the signal fed to the helical antenna elements.

Since the phi angle is held constant, it is not as obvious to see the elevation of the beam direction change. The change can be seen by looking at the nulls. When the monopole antennal element receives more power than the helical antenna elements, and the beam radiates closer to the horizon, two nulls seen in a typical monopole radiation pattern are evident, even though the second null is slightly shifted due to the helical elements. As progressively more power is fed to the helical elements, the second null eventually converges with the first one, and the antenna radiates at broadside, as a helical antenna naturally radiates. In the previous plots, the back lobe of the radiation pattern shrinks as power is directed away from the monopole element and relatively to the helical elements.

While the invention is described through the above-described exemplary embodiments, modifications to, and variations of, the illustrated embodiments may be made without departing from the inventive concepts disclosed herein. Furthermore, disclosed aspects, or portions thereof, may be combined in ways not listed above and/or not explicitly claimed. Accordingly, the invention should not be viewed as being limited to the disclosed embodiments.

Although aspects of embodiments may be described with reference to flowcharts and/or block diagrams, functions, operations, decisions, etc. of all or a portion of each block, or a combination of blocks, may be combined, separated into separate operations or performed in other orders. All or a portion of each block, or a combination of blocks, may be implemented as computer program instructions (such as software), hardware (such as combinatorial logic, Application Specific Integrated Circuits (ASICs), Field-Programmable Gate Arrays (FPGAs) or other hardware), firmware or combinations thereof. Embodiments may be implemented by a processor executing, or controlled by, instructions stored in a memory. The memory may be random access memory (RAM), read-only memory (ROM), flash memory or any other memory, or combination thereof, suitable for storing control software or other instructions and data. Instructions defining the functions of the present invention may be delivered to a processor in many forms, including, but not limited to, information permanently stored on tangible non-writable storage media (e.g., read-only memory devices within a computer, such as ROM, or devices readable by a computer I/O attachment, such as CD-ROM or DVD disks), information alterably stored on tangible writable storage media (e.g., floppy disks, removable flash memory and hard drives) or information conveyed to a computer through a communication medium, including wired or wireless computer networks. Moreover, while embodiments may be described in connection with various illustrative data structures, systems may be embodied using a variety of data structures.

What is claimed is:

1. A radio frequency transmitting antenna having a design frequency and being electronically steerable independently in both phi and theta directions, the antenna comprising:

at least one helical antenna transmitting element wound about a single longitudinal axis and defining a volume, wherein dimensions of the at least one helical antenna transmitting element are based on the design frequency; and;

a straight antenna transmitting element disposed within the volume and oriented along the single longitudinal axis, the straight antenna transmitting element being configured to be fed at a proximal end, the distal end of the straight antenna transmitting element terminating without electrical connection to any other antenna element, wherein length of the straight antenna transmitting element is based on the design frequency; wherein:

the at least one helical antenna transmitting element and the straight antenna transmitting element are configured to cooperate to: (a) electronically steer a radiation pattern of the antenna in the phi direction in response to a phase difference between first and second radio frequency signals having equal frequencies and fed, respectively, to (1) the at least one helical antenna transmitting element and (2) the straight antenna transmitting element, and (b) electronically steer the radiation pattern in the theta direction in response to an amplitude ratio of the first and second radio frequency signals.

2. An antenna according to claim 1, further comprising a feed circuit electrically coupled to the at least one helical antenna transmitting element and to the straight antenna transmitting element, the feed circuit being configured to:

receive a phi control signal;

receive a theta control signal distinct from the phi control signal;

provide the first radio frequency signal to the at least one helical antenna transmitting element and provide the second radio frequency signal to the straight antenna transmitting element;

control relative phase of the first and second radio frequency signals, based on the phi control signal; and control relative amplitude of the first and second radio frequency signals, based on the theta control signal.

3. An antenna according to claim 2, wherein the feed circuit comprises a variable delay circuit configured to control the relative phase of the first and second radio frequency signals.

4. An antenna according to claim 1, further comprising a ground plane disposed adjacent one end of the at least one helical antenna transmitting element and oriented perpendicular to the single longitudinal axis.

5. An antenna according to claim 1, wherein the at least one helical antenna transmitting element comprises four helical antenna transmitting elements arranged as a quadrifilar helix.

6. An antenna according to claim 5, further comprising a feed circuit electrically coupled to the straight antenna transmitting element and to each helical antenna transmitting element of the quadrifilar helix and configured to:

receive a phi control signal;

receive a theta control signal distinct from the phi control signal;

provide the first radio frequency signal to the at least one helical antenna transmitting element, such that each helical antenna transmitting element of the quadrifilar helix receives a radio frequency signal that is shifted by an integral multiple of 90°, relative to the other helical antenna transmitting elements of the quadrifilar helix;

provide the second radio frequency signal to the straight antenna element;

control relative amplitude of the first and second radio frequency signals, based on the theta control signal; and control relative phase of the first and second radio frequency signals, based on the phi control signal.

7. A method for electronically steering a radio frequency antenna in phi and theta directions independently, the method comprising:

receiving a phi control signal;

receiving a theta control signal distinct from the phi control signal;

providing a first radio frequency signal to at least one helical antenna element, the first radio frequency signal having a frequency;

providing a second radio frequency signal to a straight antenna element disposed along an axis of the at least one helical antenna element and within a volume defined by the at least one helical antenna element, the second radio frequency signal having a frequency equal to the frequency of the first radio frequency signal;

controlling relative amplitude of the first and second radio frequency signals, based on the theta control signal, to electronically steer a radiation pattern of the antenna in the theta direction; and controlling relative phase of the first and second radio frequency signals, based on the phi control signal, to electronically steer the radiation pattern in the phi direction.

8. A method according to claim 7, wherein controlling the relative phase of the first and second radio frequency signals comprises delaying one of the first and second radio frequency signal by an amount that depends on the phi control signal.

9. A method according to claim 7, wherein the electronically steerable radio frequency antenna has a design frequency, the method further comprising:

providing the at least one helical antenna element, wherein dimensions of the at least one helical antenna element are based on the design frequency; and providing the straight antenna element, wherein length of the straight antenna element is based on the design frequency.

10. A method according to claim 7, wherein providing the first radio frequency signal to the at least one helical antenna element comprises:

providing the first radio frequency signal to four helical antenna elements arranged as a quadrifilar helix, such that each helical antenna element of the quadrifilar helix receives a radio frequency signal that is shifted by an integral multiple of 90°, relative to the other helical antenna elements of the quadrifilar helix.

11. A radio frequency antenna, comprising:

at least one helical antenna element wound about a single longitudinal axis and defining a volume;

a straight antenna element disposed within the volume and oriented along the single longitudinal axis; and a feed circuit configured to:

receive a phi control signal;

receive a theta control signal distinct from the phi control signal;

provide a first radio frequency signal to the at least one helical antenna element and provide a second radio frequency signal to the straight antenna element, wherein frequencies of the first and second radio frequency signals are equal;

control relative phase of the first and second radio frequency signals, based on the phi control signal; and control relative amplitude of the first and second radio frequency signals, based on the theta control signal; wherein:

the at least one helical antenna element and the straight antenna element are configured to cooperate to: (a) electronically steer a radiation pattern of the electronically steerable radio frequency antenna in a phi direction in response to the phi control signal and (b) electronically steer the radiation pattern in a theta direction in response to the theta control signal.

12. An electronically steerable radio frequency antenna according to claim 11, further comprising a ground plane disposed adjacent one end of the at least one helical antenna element and oriented perpendicular to the single longitudinal axis.

13. An electronically steerable radio frequency antenna according to claim 11, wherein the at least one helical antenna element comprises four helical antenna elements arranged as a quadrifilar helix.

14. An electronically steerable radio frequency antenna according to claim 13, wherein the feed circuit is configured to provide the first radio frequency signal to the at least one helical antenna element, such that each helical antenna element of the quadrifilar helix receives a radio frequency signal that is shifted by an integral multiple of 90°, relative to the other helical antenna elements of the quadrifilar helix.

15. An electronically steerable radio frequency antenna according to claim 11, wherein:

the electronically steerable radio frequency antenna has a design frequency;

dimensions of the at least one helical antenna element are based on the design frequency; and length of the straight antenna element is based on the design frequency.

16. An electronically steerable radio frequency antenna, comprising:

at least one spiral antenna element disposed in a plane and wound about a center;

a straight antenna element having a longitudinal axis that is: (a) perpendicular to the plane and (b) extends through the center; and a feed circuit configured to:

receive a phi control signal;

receive a theta control signal distinct from the phi control signal;

provide a first radio frequency signal to the at least one spiral antenna element and provide a second radio frequency signal to the straight antenna element, wherein frequencies of the first and second radio frequency signals are equal;

control relative phase of the first and second radio frequency signals, based on the phi control signal; and control relative amplitude of the first and second radio frequency signals, based on the theta control signal; wherein:

the at least one spiral antenna element and the straight antenna element are configured to cooperate to: (a) electronically steer a radiation pattern of the electronically steerable radio frequency antenna in a phi direction in response to the phi control signal and (b) electronically steer the radiation pattern in a theta direction in response to the theta control signal.

* * * * *